US005682632A

United States Patent [19]

Cotroneo

[11] Patent Number: 5,682,632

[45] Date of Patent: Nov. 4, 1997

[54] JAW THRUST SUPPORT

[76] Inventor: James L. Cotroneo, 7092 Thames Rd., Woodbury, Minn. 55125

[21] Appl. No.: 637,870

[22] Filed: Apr. 25, 1996

[51] Int. Cl.[6] ..... A47G 9/00; A47C 20/00

[52] U.S. Cl. ..... 5/636; 5/638; 5/637

[58] Field of Search ..... 5/636, 637, 638

[56] References Cited

U.S. PATENT DOCUMENTS

| | | | |
|---|---|---|---|
| 2,199,479 | 5/1940 | Cappel . | |
| 2,336,707 | 12/1943 | Thompson | 5/636 |
| 3,864,766 | 2/1975 | Prete, Jr. | 5/636 |
| 4,218,792 | 8/1980 | Kogan | 5/636 |
| 4,259,757 | 4/1981 | Watson . | |
| 4,285,081 | 8/1981 | Price | 5/637 |
| 4,345,347 | 8/1982 | Kantor . | |
| 4,393,530 | 7/1983 | Stark . | |
| 4,494,261 | 1/1985 | Morrow | 5/636 |
| 4,550,458 | 11/1985 | Fiore . | |
| 4,832,007 | 5/1989 | Davis, Jr. et al. | 5/636 |
| 5,265,625 | 11/1993 | Bodman | 5/637 |
| 5,400,802 | 3/1995 | Niemeyer et al. . | |

OTHER PUBLICATIONS

Trauma Life Support Manual, Section 1, Chapter 1, "Respiratory Procedures", Joseph E. Clinton and Ernest Ring, 1984.

"CPR, Looking at the Basics and Adjuncts", Mikel A. Rothenberg M.D., Journal of Emergency Medical Services, Feb. 1996, pp. 45–50.

*Primary Examiner*—Rodney M. Lindsey
*Assistant Examiner*—Fredrick Conley
*Attorney, Agent, or Firm*—Gregory F. Cotterell

[57] ABSTRACT

A jaw thrust support suitable for engaging the angles of the mandible of a patient for accomplishing a jaw thrust maneuver to proved a patient with a patent airway. The device is constructed of polymeric materials suitable for conforming to the angles of the patient's jaw while continuing to provide suitable support to the jaw by distracting the jaw forward away from the patient's head and neck thus distracting the patient's tongue and associated support structures lifting the tongue from the patient's oropharynx and hypopharynx and lifting the epiglottis from in front of the patient's laryngeal opening.

17 Claims, 2 Drawing Sheets

JAW THRUST SUPPORT

BACKGROUND OF THE INVENTION

1. Field of the Invention

The present invention relates to headrests for use with patients and in particular to headrest providing mandibular, or jaw, support.

2. Background of the Invention

Patient airway management is vital to appropriate patient care in a multitude of varying circumstances. The rationale supporting and driving this approach is the acutely injured person is often unable to maintain their own airway secondary to their lethargic, obtunded or unconscious condition. Even in the more controlled settings, such as operating room environments, patients about to undergo anesthesia are given medications that may impair the patient's ability to maintain their own airway. In all of these circumstances, appropriately trained medical personnel must intervene on behalf of the patient to establish and maintain patent airways in all of these patients. Securing a patent airway is taught to all medical care providers as the first step in appropriate management. See *Resuscitating CPR, Looking at the Basics and Adjuncts,* Mikel A. Rothenberg, M.D., Journal of Emergency Medical Services, February, 1996, pp. 45–50.

There are several recognized maneuvers medical personnel may use with these patients in order to adequately open the patient's airway. In one such emergency medical publication titled *Trauma Life Support Manual,* in chapter one: *Respiratory Procedures,* the authors Joseph E. Clinton and Ernest Ruiz, strongly recommend that some type of jaw thrust or chin lift maneuver should be performed on every unconscious patient to ensure airway patency. Id., chapter one, page one. However, a chin lift maneuver requires at least one hand in order to accomplish the maneuver and a jaw thrust maneuver uses two hands to complete the maneuver. In order to maintain the airway patency, the chin lift or jaw thrust maneuver must be maintained until the patient either regains consciousness and is able to protect their own airway or an artificial airway is placed by the emergency medical personnel, such as an oropharyngeal airway, an orotracheal airway, etc.

Opening and maintaining a patent airway is only the first step. Many patients requiring medical personnel to maintain a patent airway, also necessitate that the medical personnel undertake the task of breathing for the patient as well. Even with simple procedures such as a bag valve mask placed over the patient's mouth and nose, considerable skill and art are required to place the mask over the nose and mouth, obtain an adequate seal around these orifices, complete a jaw thrust maneuver, hold it, and then subsequently squeeze the bag in order to deliver the breath of air. Another difficulty is also encountered. Routinely, a patient is placed on a smooth, hard surface such as a long back board. When the medical care provider is ventilating the patient with a bag valve mask, a certain amount of pressure is required to seal the mask to the skin of the patient's face to deliver an adequate ventilation. This downward pressure causes the head to slide into a more neutral position drawing the chin toward the patient's chest. This position will fold the tongue and related structures down toward the laryngeal inlet restricting airflow during ventilation. Additionally, the round shape of the patient's occiput against a hard flat surface also creates a problem of lateral head movement, particularly prevalent during transportation to a medical facility. It is not uncommon for medical care providers to place the patient's head between the knees of the care provider to facilitate some degree of stabilization while the care provider is attending to the patient. As is evident, often seemingly straight forward procedures as securing an airway and giving a patient a breath of air require more hands than the medical provider has available. The space around an obtunded or unconscious patient's head is limited and only so many medical personnel will be able to work around the patient's head area.

Many ambulance, paramedic and rescue rigs providing emergency medical services in the field only carry two emergency medical personnel. Once the patient's initial emergency medical needs are provided, the patient is then transported in the vehicle with only one emergency medical provider in attendance while the other drives. Such staffing of emergency medical rigs for field work may stretch to such an extent a medical care provider's ability to provide adequate airway management as to become unsafe during transport.

There are a number of known headrests and cushion supports useful to those skilled in the medical arts. One such support cushion is disclosed in U.S. Pat. No. 4,259,757 issued Apr. 7, 1981 to Watson wherein a support cushion is described having two components useful for supporting a patient's head during various surgical procedures such as ear, nose and throat surgeries and endotracheal intubation. Watson discusses the need for obtaining appropriate airway alignment in order to carry out an endotracheal procedure but Watson does not disclose, teach or suggest any method or instrument to obtain this alignment and maintain it other than allowing the patient's head to rest on the head support cushion.

Another disclosure is contained in U.S. Pat. No. 2,199,479 issued May 7, 1940 to Cappel in which there is disclosed a pillow useful for resting a patient's head and neck on in order to assist an anesthesiologist or anesthetist by placing a slight extension in the patient's neck. This slight extension is achieved by placing the patient's head to rest in the central recess and a rim of the pillow under the neck. According to the Cappel disclosure this positioning makes it possible for the anesthetist to be relieved of the duty of using one of his or her hands in holding the patient's head in a correct position. As in the other disclosure, this disclosure also recognizes the need for positioning but does not disclose, teach or suggest any other mechanism or device for obtaining airway patency other than merely resting the patient's head and/or neck onto the surface of a pillow or cushion.

For those skilled in this art, the ideal patient positioning is to place the patient into or as near as possible to the "sniffing" position such that the patient's neck is slightly flexed at the cervicothoracic junction and is slightly extended at the cervicocephalic junction. When so positioned, a patient appears to be "sniffing". An adequate description of this procedure is detailed in the above-identified article by Clinton and Ruiz.

After placing the patient's head and neck in this position, the patient's jaw, or mandible, is then elevated away from the patient's neck in either a chin lift or jaw thrust maneuver. Elevation of the mandible away from the head and neck provides distraction of the tongue and associated connective tissue structures, including the mylohyoideus, hyoid bone, and hyo-epiglottic ligament attached to the epiglottis, lifting the tongue away from the area of the oropharynx and hypopharynx and the epiglottis from in front of the laryngeal inlet thus opening the patient's airway from the level of the vocal cords on out to the patient's lips. Once this patient positioning is achieved, any number of breathing techniques and establishment of secondary airways may be accomplished.

In trauma situations, the status of the patient's cervical spine is highly suspect. In these circumstances, the patient's cervical spine is immobilized with a rigid collar. Then a modified positioning is achieved where flexion or extension of the neck is not performed but the chin lift or jaw thrust maneuver is performed with all patient's whether or not they are placed in a cervical collar because of the need for providing an adequate and patent airway.

Placement of a cervical collar does not preclude the use of at least a jaw thrust maneuver as a first step in obtaining a patent airway. Cervical collars are designed to place the patient's head in a slight extension with the patient's chin resting on an upper surface of the cervical collar. In most circumstances, the presence of a cervical collar under the patient's chin precludes use of a chin life maneuver. In these patients, the jaw thrust maneuver is still available and is the maneuver of choice as the first step in obtaining an adequate and patent airway.

As mentioned, there are a number of headrest and head immobilizers known to those skilled in the art. All of these devices to lesser or greater extent assist health care providers in immobilizing or positioning a patient's head, relative to their neck and thorax. However, the need for assisting health care providers, particularly in trauma circumstances in the field, does not end with immobilization of a patient's head or spine. The very next step that is taught to all medical personnel trained to deliver emergency medical care, is to obtain and maintain an adequately patent airway. There is an immediate need for a device capable of providing mandibular support relative to a patient's head and neck in a position known to increase the patency of a patient's airway.

SUMMARY OF THE INVENTION

The patient jaw thrust support of the present invention comprises a device which is placed under a patient's head region at the occipito-cervical junction as a headrest having a jaw thrust support positionable on an upper surface of the headrest that is engageable with the patient's mandible, particularly at the angles of the mandible on either side. The present invention engages and thrusts out the patient's mandible in relationship to the patient's head and neck, distracting the patient's tongue and associated support structures, including the mylohyoideus, hyoid bone, and hyo-epiglottic ligament attached to the epiglottis, moving the tongue out of the oropharynx and hypopharynx areas and the epiglottis out from in front of the laryngeal inlet. The support to the mandible provided by the present invention is substantially equivalent to the two-handed jaw thrust maneuver used by health care providers in achieving the same goal of lifting the jaw and distracting with it the tongue and associated connective structures. The jaw thrust support of the present invention has two additional advantages. The first is freeing up the care giver's hands providing freedom to go on to other tasks to assist the patient further. Secondly, the jaw thrust of the present invention stabilizes the patient's head position, substantially limiting motion of the patient's head relative to their cervical spine.

The present invention uses materials and components having compression and conforming characteristics such that the jaw thrust support is not so compressible as to collapse and allow the jaw to sag, but compressible to an extent so as to allow conformation of the surface of the jaw thrust support to the contours of the angle of the mandible on either side. Achieving the proper ratio of support to acceptable deformation and contouring the mandible engaging surface of the jaw thrust support is important in the concept embodied by the present invention so as to eliminate focal or excessive pressure points in the skin and other structures such as the parotid glands found at each angle of the mandible.

The present invention also recognizes the need for fluid impermeable surfaces that are both durable and sterilizable. In trauma settings, as well as hospital settings, there is the ever-increasing need to eliminate the risk of contamination to health care providers and subsequent use patients. Adequate containment of potential contaminants and infectious agents can be accomplished by applying durable, sterilizable yet pliable fluid impervious materials in the cover of the jaw thrust support of the present invention.

Other objects of the present invention and many of the attendant advantages of the present invention will be readily appreciated as the same become better understood by reference to the following detailed description when considered in connection with the accompanying drawings.

DETAILED DESCRIPTION OF THE INVENTION

Figure 1:
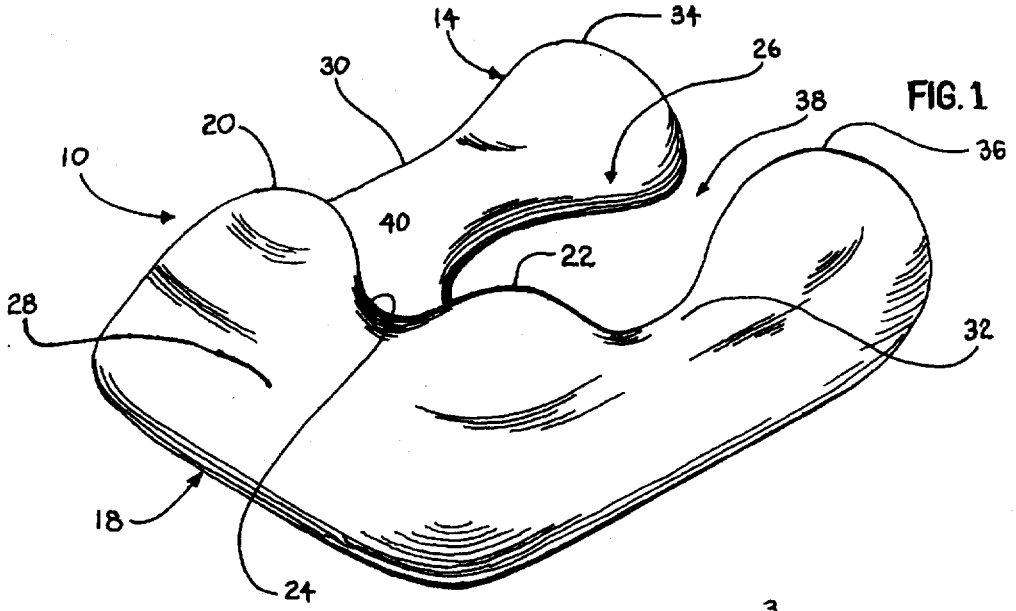
FIG. 1 is a perspective view of a jaw thrust support in accordance with the present invention.
Figure 2:
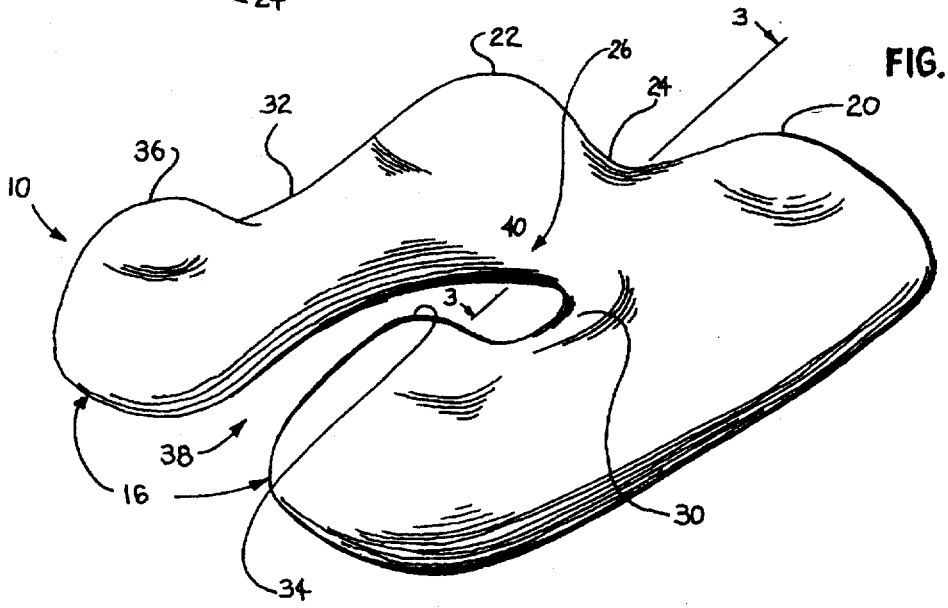
FIG. 2 is a perspective view of the jaw thrust support of in FIG. 1 rotated to view the opposite perspective.
Figure 3:
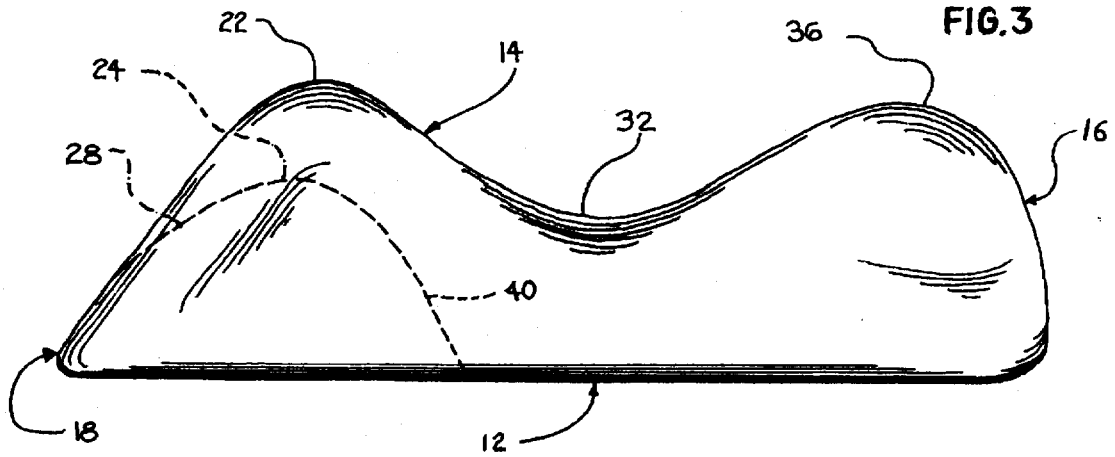
FIG. 3 is a side elevational view of the device depicted in FIG. 1 with a profile of the surface contour at line 3—3 of FIG. 2 depicted in phantom.

Referring to FIGS. 1, 2 and 3, there is disclosed a jaw thrust support device 10 having a bottom surface 12, and an upper surface 14, a first end 16, a second end 18, and at least two jaw thrust supports 20, 22 depicted as protuberances from upper surface 14. Extending between bottom surface 12 and upper surface 14 is a head support surface 40 in a substantially circular shape forming a head recess 26. On upper surface 14 between jaw thrust supports 20 and 22, there is a neck support groove 24 which is co-extensive with head support surface 40 and a nape of the neck support surface 28 extending towards second end 18. In this preferred embodiment, there are ear hollows 30, 32 as part of upper surface 14 that are contiguous with and between jaw thrust supports 20, 22 and a second set of jaw thrust supports 34, 36 depicted as protuberances of upper surface 14 near first end 16. Jaw thrust supports 34, 36 are separated from each other by a cervical collar cleft 38 at first end 16.

The preferred embodiment as depicted in FIGS. 1–5 is a combination of two sets of jaw thrust supports having a first set of jaw thrust supports 20, 22 adapted for those patients not wearing a cervical collar. The second set of jaw thrust supports 34, 36 arranged on the same support device as the other jaw thrust supports are adapted for use on patients wearing a cervical collar. This particular combination has proven convenient as well as useful lessening the requirement for multiple jaw thrust support devices for different circumstances. It is not necessary to the present invention to limit the device to two pairs of jaw thrust supports. The present invention anticipates that a single pair of jaw thrust supports configured for supporting the jaw along with the head and neck, either with or with out a cervical collar, is also a part of the present invention.

As shown in the various figures, the preferred embodiment is substantially "U" shaped in configuration. It is anticipated that the present invention could alternately be constructed with a single set of jaw thrust supports. One alternative embodiment, not depicted, would be similar in construction to jaw thrust supports 20, 22 with a surface between them similar to neck support groove 24 and having a ramp and surface similar to nape of neck support 28. Such a device would be useful for those patients known to not have any cervical spine injury in either a trauma circumstance or in an in-house hospital setting such as pre-operative anesthesia preparation and during anesthesia delivery as well as during acute resuscitation of patients in the emergency room or in the hospital wards and rooms.

The present invention also anticipates a single set of jaw thrust supports similar to jaw thrust supports 34, 36 with a cleft between them similar to cervical collar cleft 38. In the absence of the combined device as depicted, the jaw thrust supports could be connected with a thin, flexible web-like material at a surface similar to and contiguous with lower surface 12 spanning the cleft between the two jaw thrust supports.

Construction of the present invention includes a number of materials known to those skilled in the art. To comply with OSHA standards or similar requirements, the preferred embodiment has an outer layer of fluid impervious polymeric material surrounding a polymeric foam shaped to provide the elements of the present invention. There are known to those skilled in the art a number of different suitable polymeric coatings and suitable polymeric foams. A typical example of a suitable fluid impervious polymeric coating is polyvinyl. An example of a suitable polymeric foam having depression, conformation, rebound, hardness and impact absorption suitable for use in a device according to the present invention is polyurethane. It is anticipated that a number of different polymeric materials are suitable and applicable in the present invention and it is not intended that the present invention be limited to just these polymers.

Figure 4:
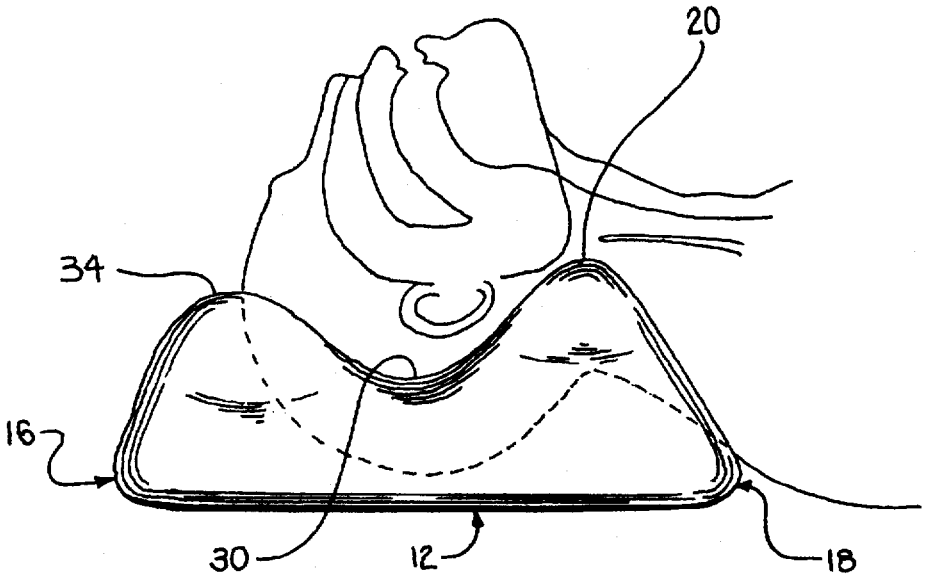
FIG. 4 is a side elevational view from the opposite direction as that depicted in FIG. 3 and additionally including positioning a patient in reference to the jaw thrust support of the present invention with the posterior aspect of the patient's head and neck depicted in phantom.

In operation and in reference to FIG. 4, jaw thrust support device 10 is positioned with lower surface 12 on a patient support surface such as a stretcher or back board, not shown. Alternatively, for trauma settings in the field, the patient support surface may be the actual ground on which the trauma victim is found. Jaw thrust device 10 is then positioned so that the patient's head will rest within head recess 26 and the patient's neck lays against and is supported by neck support groove 24 and nape of neck support 28, ramping down and towards the patient's shoulders. When positioned, the base of the patient's head is slightly elevated above the patient support surface. During the positioning of the head and neck, the patient's mandible comes to lay between jaw thrust supports 20, 22 which engage both angles of the mandible to the patient's right and left respectively. The weight of the patient's head is sufficient to maintain the head's position within head recess 26, so that engagement of jaw thrust supports 20, 22 at both angles of the mandible provide sufficient support so to keep the mandible out from the lower head and neck distracting the patient's tongue and associated support structures, including the mylohyoideus, hyoid bone, and hyo-epiglottic ligament attached to the epiglottis, moving the tongue out of the oropharynx and hypopharynx areas and the epiglottis out from in front of the laryngeal inlet.

Figure 5:
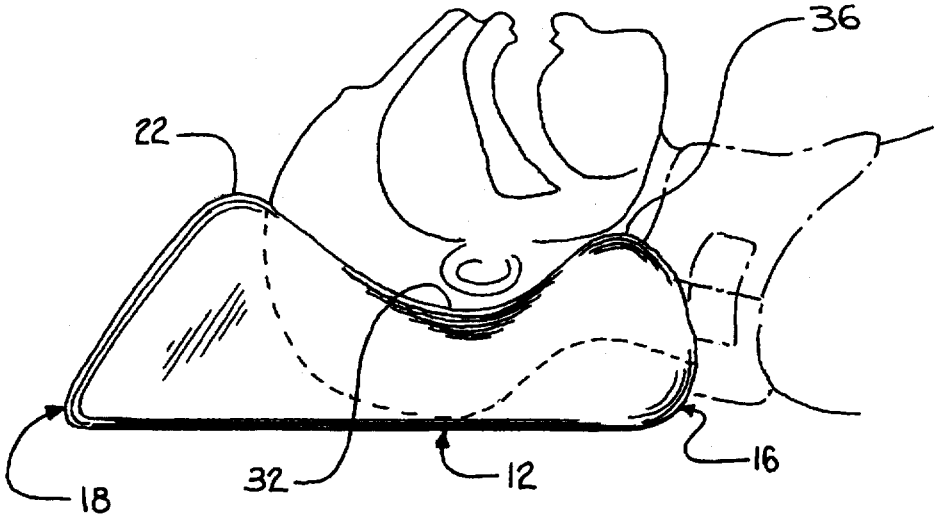
FIG. 5 is a side elevational view similar to that of FIG. 3 and in addition depicting the positioning of a patient wearing a C-Spine immobilizing collar with the posterior aspect of the patient's head and neck depicted in phantom.

Turning to FIG. 5, jaw thrust support device 10 is depicted for use with those patients additionally immobilized with a cervical collar. Jaw thrust device 10 is positioned so that the patient's head will rest within head recess 26 with the patient's neck supported by the cervical collar and the cervical collar lays within cervical collar cleft 38. When positioned, the base of the patient's head is not slightly elevated above the patient support surface thus not placing any undue flexion forces on the cervical spine. During the positioning of the head and neck, the patient's mandible comes to lay between jaw thrust supports 34, 36 which engage both angles of the mandible to the patient's left and right respectively. The weight of the patient's head is sufficient to maintain the head's position within head recess 26, so that engagement of jaw thrust supports 34, 36 at both angles of the mandible provide sufficient support so to keep the mandible out from the lower head and neck distracting the patient's tongue and associated support structures, including the mylohyoideus, hyoid bone, and hyo-epiglottic ligament attached to the epiglottis, moving the tongue out of the oropharynx and hypopharynx areas and the epiglottis out from in front of the laryngeal inlet.

The foregoing description is considered as illustrative only of the principles of the invention, and since numerous modifications and changes will readily occur to those skilled in the art, it is not the inventor's desire to limit the invention to the exact construction and operation shown and described herein. Accordingly, all suitable modifications and equivalents may be resorted to, falling within the scope of the present invention.

What is claimed is:

1. A head rest device for use under a patient's head, the device comprising:

a base having an upper surface suitable for placement under at least a portion of the patient's head and receiving the patient's head thereon; and a jaw thrust support having at least two protuberances extending upward from the upper surface of the base for engaging with the patient's mandible at angles of the mandible so that the patient's mandible is thrust out distracting the patient's tongue and associated structures in a direction away from the patient's head and neck, and in so doing, opening the patient's oropharynx and hypopharynx and lifting the patient's epiglottis out from in front of the patient's laryngeal inlet.

2. The device of claim 1 in which the at least two protuberances include surfaces suitably contoured to engage the patient's mandible at the angles.

3. The device of claim 2 further comprising a nape of the neck support positioned between the at least two protuberances for supporting the patient's neck near the region of the patient's head.

4. The device of claim 2 further comprising a cleft positioned between the at least two protuberances suitable for providing a space for a cervical collar worn by the patient.

5. The device of claim 1 in which the jaw thrust support is constructed using flexible suitably resilient polymeric foam.

6. The device of claim 5 in which the polymeric foam includes a polymer of polyurethane.

7. The device of claim 5 in which the polymeric foam is covered using a fluid impervious flexible polymeric covering.

8. The device of claim 7 in which the polymeric covering includes a polymer of polyvinyl chloride.

9. A head rest device for use under a patient's head and neck when the patient is on a patient support surface, the device comprising:

a body having a front end and a rear end, a substantially flattened base surface for resting on the patient support surface, a top surface substantially coplanar with the base surface, an outer side surface extending between the base and top surfaces and a substantially broadly ellipsoidal recess in the top surface for suitable engagement with the occipital region of the patient's head; and a jaw thrust support, on the top surface, for positioning at the patient's mandible when the patient's head is resting in the recess, for engaging with the patient's mandible at the angles of the mandible so that the patient's mandible is thrust out in relation to the patient's head and neck distracting the patient's tongue and associated structures in a direction away from the patient's head and neck, and in so doing, opening the patient's oropharynx and hypopharynx and lifting the patient's epiglottis out from in from of the patient's laryngeal inlet.

10. The device of claim 9 in which the jaw thrust support comprises a plurality of protuberances.

11. The device of claim 10 in which the plurality of protuberances includes two protuberances positioned near the front end, the device further comprising a nape of the neck support, positioned between the two protuberances, suitable for supporting the patient's neck in the region of the patient's head.

12. The device of claim 10 in which the plurality of protuberances includes two protuberances positioned near the rear end, the device further comprising a cleft positioned between the two protuberances suitable for receiving a patient's neck while wearing a cervical collar so that the patient's neck does not receive undue flexion forces.

13. The device of claim 10 in which the plurality of protuberances includes two protuberances positioned near the front end and two protuberances positioned near the rear end, the device further comprising a nape support, positioned between the two protuberances at the front end, suitable for supporting the patient's neck in the region of the patient's head, and a cleft positioned between the two protuberances at the rear end suitable for receiving a patient's neck while wearing a cervical collar so that the patient's neck does not receive undue flexion forces.

14. The device of claim 9 in which the jaw thrust support is constructed using flexible suitably resilient polymeric foam.

15. The device of claim 14 in which the polymeric foam is constructed using a polymer of polyurethane.

16. The device of claim 14 in which the polymeric foam is covered using a fluid impervious flexible polymeric covering.

17. The device of claim 16 in which the polymeric covering is constructed using a polymer of polyvinyl chloride.

* * * * *

UNITED STATES PATENT AND TRADEMARK OFFICE

CERTIFICATE OF CORRECTION

PATENT NO. : 5,682,632

DATED : November 4, 1997

INVENTOR(S) : Cotroneo, James L.

It is certified that error appears in the above-indentified patent and that said Letters Patent is hereby corrected as shown below:

On the title page, item [56],

In the first reference under OTHER PUBLICATIONS, second line, delete the word "Ring" and insert therefor --Ruiz--.

Item [57] ABSTRACT, line 3, delete "proved" and insert therefor --provide--.

Column 3, line 6, delete "patient's" and insert therefor --patients--.

Column 4, line 25, delete the word "in".

Column 5, line 5, delete the second occurrence of the word "with" and the word "out" and insert therefor --without--.

Column 5, line 63, delete the word "so".

UNITED STATES PATENT AND TRADEMARK OFFICE

CERTIFICATE OF CORRECTION

PATENT NO. : 5,682,632

DATED : November 4, 1997

INVENTOR(S) : Cotroneo, James L.

It is certified that error appears in the above-identified patent and that said Letters Patent is hereby corrected as shown below:

Column 6, line 18, delete the word "so".

Column 7, line 20, delete the second occurrence of the word "from" and insert therefor --front--.

Column 8, line 10, after the word "nape" insert the phrase --of the neck--.

Signed and Sealed this

Twenty-fourth Day of February, 1998

*Attest:*

Bruce Lehman

BRUCE LEHMAN

*Attesting Officer*

*Commissioner of Patents and Trademarks*